United States Patent [19]

Everson

[11] 4,215,517

[45] Aug. 5, 1980

[54] AUXILLIARY WINDOW FOR INDUSTRIAL AND COMMERCIAL APPLICATIONS

[75] Inventor: William Everson, Perkasie, Pa.

[73] Assignee: Perkasie Industries Corporation, Perkasie, Pa.

[21] Appl. No.: 914,854

[22] Filed: Jun. 12, 1978

Related U.S. Application Data

[63] Continuation of Ser. No. 789,554, Apr. 20, 1977, abandoned, which is a continuation-in-part of Ser. No. 687,878, May 18, 1976, Pat. No. 4,121,379.

[51] Int. Cl.[2] ..... E06B 3/28

[52] U.S. Cl. ..... 52/202; 49/61; 52/825

[58] Field of Search ..... 52/202, 203, 824; 49/61

[56] References Cited

U.S. PATENT DOCUMENTS

| | | | |
|---|---|---|---|
| 2,025,198 | 12/1935 | Conrow | 52/202 |
| 2,085,281 | 6/1937 | Wagoner | 52/476 X |
| 2,191,500 | 2/1940 | Rosling | 52/202 |
| 2,221,005 | 11/1940 | Reese | 49/61 |
| 2,304,423 | 12/1942 | Schiller | 52/628 X |
| 2,379,601 | 7/1945 | Smith | 49/61 |
| 2,530,846 | 11/1950 | Webster | 49/61 |
| 2,723,732 | 11/1955 | Pettersen | 52/476 |
| 2,841,836 | 7/1958 | Watson | 52/498 |
| 3,009,515 | 11/1961 | Albee, Jr. | 160/369 |
| 3,024,837 | 3/1962 | McPhail | 49/61 X |
| 3,158,909 | 12/1964 | Downs | 52/202 |
| 3,251,399 | 5/1966 | Grossman | 160/180 |
| 3,283,804 | 11/1966 | Yancey | 160/368 R |
| 3,360,893 | 1/1968 | Wattelez | 52/202 X |
| 4,121,379 | 10/1978 | Everson | 52/202 |

FOREIGN PATENT DOCUMENTS

| | | | |
|---|---|---|---|
| 1471249 | 1/1967 | France | 52/502 |
| 1034276 | 6/1966 | United Kingdom | 52/202 |
| 1236658 | 6/1971 | United Kingdom | 52/456 |

*Primary Examiner*—Alfred C. Perham
*Attorney, Agent, or Firm*—Woodcock, Washburn, Kurtz, Mackiewicz & Norris

[57] ABSTRACT

An auxiliary or storm window is installed inside of a conventional prime window of diverse dimensions. Plastic extrusions are cut to size on the job and are fastened around the periphery of the inside of the window. The extrusions have slots which receive plastic panels. The panels form a closure for the inside of the window. Vertical and horizontal support members are installed between the sill and header and between the side flanges on large windows to accommodate a plurality of panels which make up the closure.

5 Claims, 28 Drawing Figures

Fig. 7
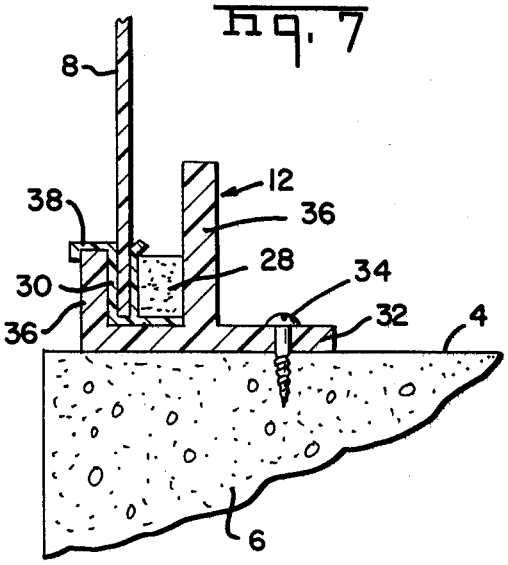
Fig. 8
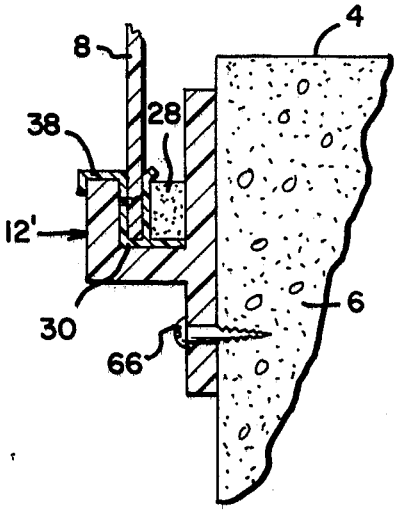
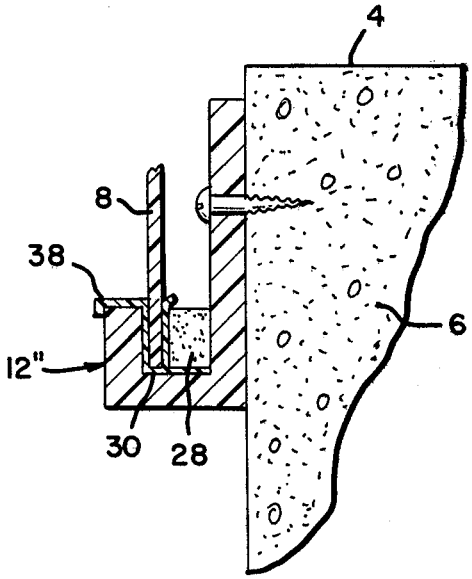
Fig. 9

AUXILLIARY WINDOW FOR INDUSTRIAL AND COMMERCIAL APPLICATIONS

RELATED APPLICATIONS

This is a continuation, of application Ser. No. 789,554, filed Apr. 20, 1977 and now abandoned, which is a continuation-in-part of application Ser. No. 687,878 filed May 18, 1976 now U.S. Pat. No. 4,121,379 and the disclosure of that application is incorporated herein by reference.

BACKGROUND OF THE INVENTION

This invention relates to auxiliary or storm windows and more particularly to a window which can be inexpensively installed on the inside of prime windows.

It has been estimated that there are 22 billion square feet of single glazed windows in industrial and commercial buildings in the United States. Heat is lost through these windows by conduction through the glass and by infiltration or leakage of cold air around the cracks of the movable sash or sections of the windows. Providing an auxiliary closure for such windows is particularly difficult because the windows are of various sizes and styles and because some of the windows are particularly large.

The prior art window weatherization techniques have not been completely satisfactory. Clear plastic film has been used because it is inexpensive and easy to install. This film has a very short life, low efficiency, poor appearance and the window cannot thereafter be operated without destroying the film. Plastic panels also have been permanently installed on windows. These have the advantage of inexpensive installation and provide good efficiency. However, they cannot be operated. Also, there is a high waste factor in installation because a full plastic sheet must normally be used in weatherizing one window.

Glass storm windows have been in use for a number of years. They are very expensive, dangerous, provide only average efficiency and present installation problems, particularly where they must be custom made to fit odd shaped windows. One such storm window is illustrated in U.S. Pat. No. 2,745,485 to Etling. Etling discloses a storm window which may be adapted to window casings of various dimensions, however these storm windows are placed within rather than over the window casing, thus requiring the installer to fit the window to rather precise dimensions.

SUMMARY OF THE INVENTION

The auxiliary closure of this invention can be installed inexpensively and quickly on the inside of existing prime windows. While the invention has particular applicability to windows in commercial, industrial and institutional buildings, the invention is also applicable to residential windows. The invention is carried out by cutting plastic extrusions to size at the site and fastening the extrusions around the periphery of the prime window. The extrusions have slots and plastic panels are inserted into the slots to form the closures.

In accordance with another aspect of the invention special extrusions have an extra slot. These special extrusions are installed around an opening to accommodate storage of a panel when it is not in use, for example, during the summer when it is desired to open a panel in the prime window.

The foregoing and other objects, features and advantages of the invention will be better understood from the following more detailed description and appended claims.

BRIEF DESCRIPTION OF THE DRAWINGS

FIG. 7 is a cross-sectional view taken along the lines 7—7 of FIG. 1 showing a typical sill member to be used on a regressed application;

FIG. 8 shows a sill member which would be used in conjunction with the header shown in FIG. 3 for an "outside the opening" type mount;

FIG. 9 shows a sill member to be used in conjunction with the header shown in FIG. 4 when the appearance of the mounting flange would be objectionable;

DETAILED DESCRIPTION OF INVENTION

The disclosed storm window is comprised of a plurality of plastic extrusions and plastic panel members which are all cut to size on the job at the time of installation thereby making it possible to fit any sized window opening. To be most effective in eliminating the loss of energy and the infiltration of cold air around the prime window frame, the disclosed storm window is mounted on the inside of the building as close as possible to the prime window.

Figure 1:
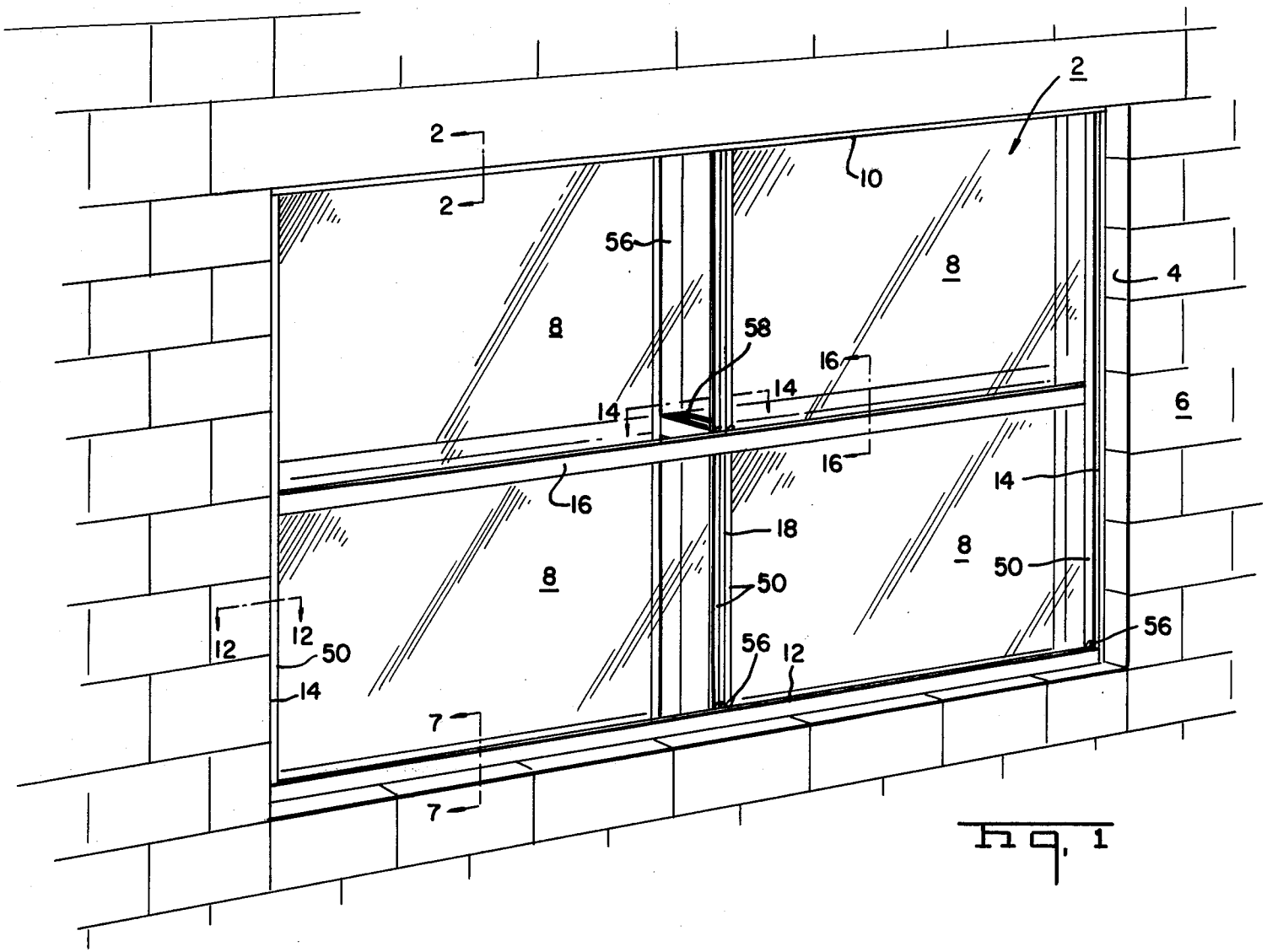
FIG. 1 is a perspective view of a storm window constructed in accordance with the present invention.
Figure 2:
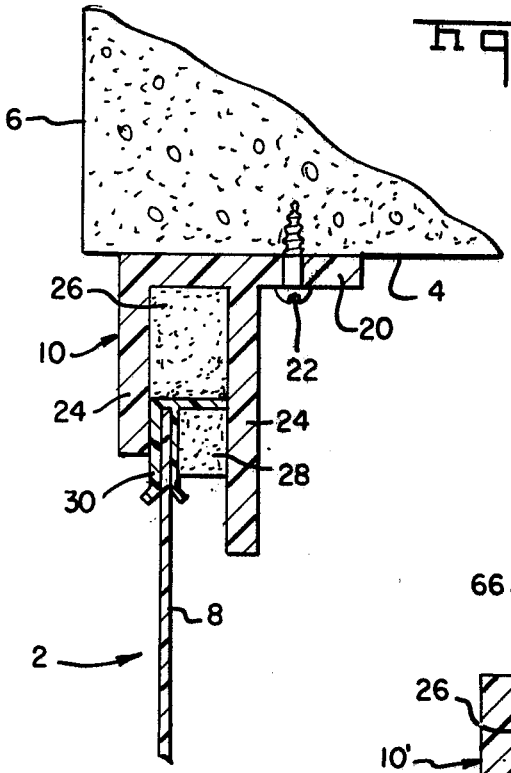
FIG. 2 is a cross-sectional view taken along the lines 2—2 of FIG. 1 showing a typical header member.
Figure 3:
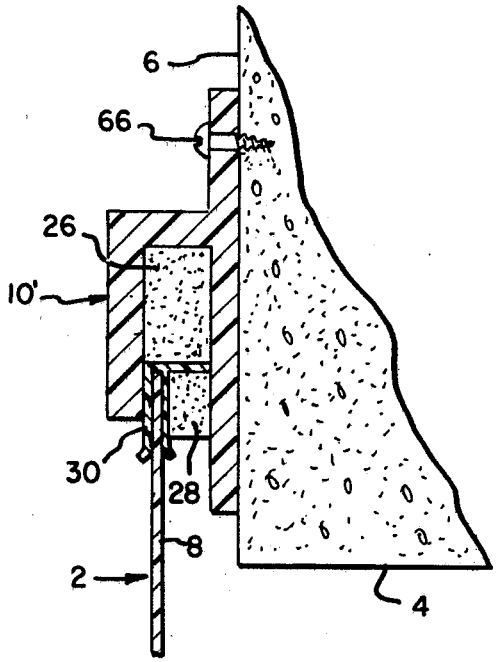
FIG. 3 is a view similar to FIG. 2 but showing a header to be used when the window is installed outside the window opening.

FIG. 1 shows a storm window 2 mounted in a regressed manner, that is, inside the window opening 4 in an exterior wall 6. The window illustrated in FIG. 1 is of a size requiring four panel members 8 but it is to be understood that the disclosed storm window can be made to fit any sized opening and can contain any number of panel members 8 to fill the needs of a particular application. When possible, the storm window is mounted inside the opening 4 as shown in FIGS. 1 & 2, but where that is not possible, the window is mounted on the inside wall outside the window opening. (FIG. 3).

Each window comprises at least a header member 10, a sill member 12, two side flanges 14, a panel 8 and means to retain the panel in a manner in which it can easily be removed when desired (to be described below). When a plurality of panels are to be used, horizontal support members 16 and vertical support members 18 are also used to support and retain the panel members. A regressed type header 10 as shown in FIG. 2 has a base member 20, through which it is secured to the opening as at 22, and a pair of depending legs 24 which retain the upper edge of panel member 8. A rubber gasket 26 is provided between the legs 24 to seal against infiltration and to spring bias the panel member downwardly to maintain it in the sill member 12 (assuming a single panel installation) or in the horizontal support 16 (in multiple panel installations). To further seal against infiltration, a second gasket 28 is provided on the backside of a panel edge molding 30, this molding being provided for all four panel edges. A cooperating sill member 12 as shown in FIG. 7, has a base 32 through which it is mounted as at 34 and a pair of upstanding legs 36 which retain the lower edge of a panel member 8. The legs 36 are considerably shorter than the legs 24 on header 10 to enable the panel 8 to be inserted or removed by compression of the rubber gasket 26 with upward motion of the panel 8 which allows it to clear the outside leg 36 of the sill member. The panel edge molding on the sill side, has an extension 38 to provide a means of grasping the panel 8 for removal.

Figure 12:
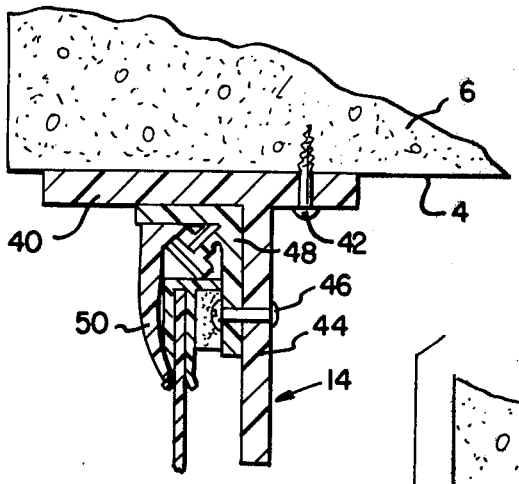
FIG. 12 is a cross-sectional view taken along the lines 12—12 of FIG. 1 showing a typical side flange to be used in a regressed application.
Figure 13:
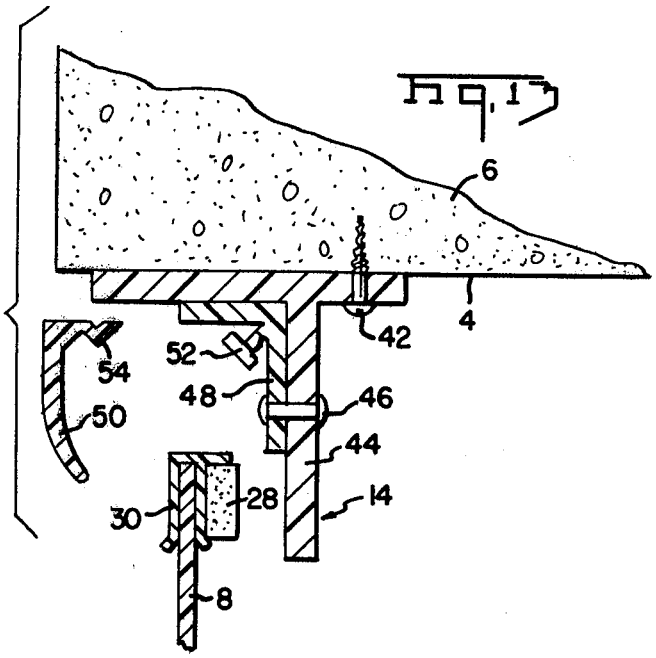
FIG. 13 is a view similar to FIG. 12 but showing the panel retention means in exploded position.
Figure 21:
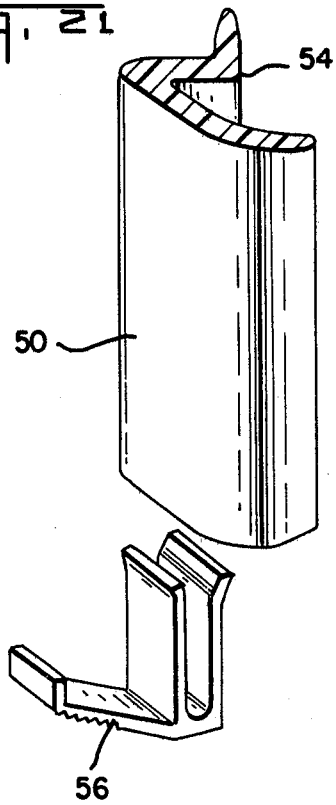
FIG. 21 is a perspective view illustrating a device to aid in the removal of the panel retention members.
Figure 22:
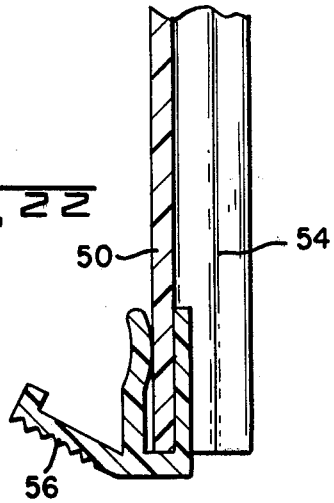
FIG. 22 is a cross-sectional view illustrating the device of FIG. 21.

Side flange members 14 (FIGS. 12 & 13) are provided to support the vertical edges of the panel 8. This flange has a base member 40 through which it is secured in the window opening 4 as at 42, and a depending leg 44 to which is riveted as at 46, a panel retention gripping member 48 which cooperates with a panel cover member 50 to retain the panel 8 along with its edge moldings 30 and sealing gaskets 28. Member 48 has a flexible detent 52 which cooperates with a "V" shaped projection 54 on the cover member 50 to enable cover 50 to be snapped in place as shown in FIG. 12 from the front, to retain the panel's vertical edges. When removal of a panel is desired, the covers 50, by means of a small grasping member 56 (FIGS. 21 & 22), are popped out of their engagement with member 48 and are removed, thereby freeing the vertical edges of the panel 8. The panel is then raised to compress gasket 26 till the panel bottom clears the sill member 12 and the panel is removed. The reverse procedure is used to install a panel.

Figure 14:
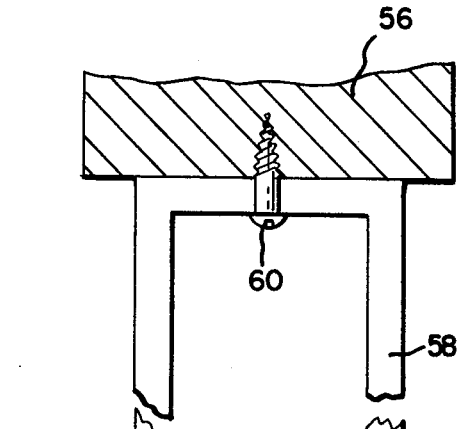
FIG. 14 is a cross-sectional view taken along the lines 14—14 of FIG. 1 showing a vertical support member and it's associated panel retention means.
Figure 15:
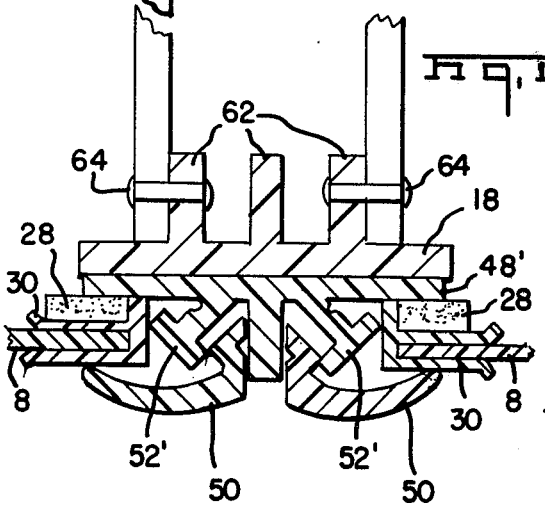
FIG. 15 is a view similar to FIG. 14 but showing the various elements in exploded position.
Figure 15:
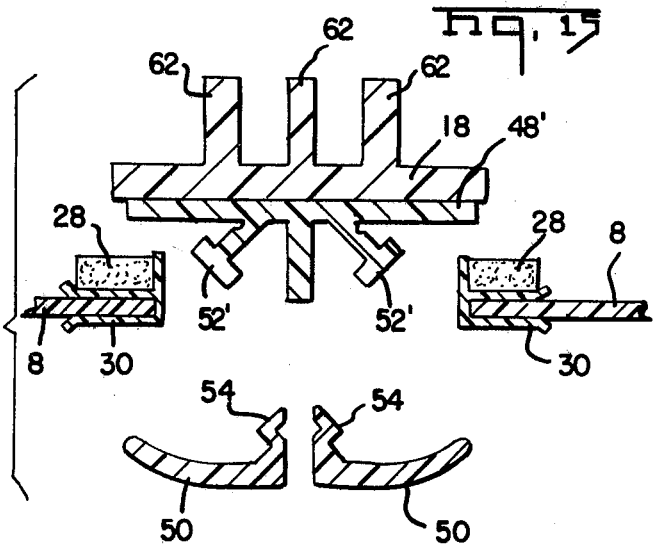
Figure 17:
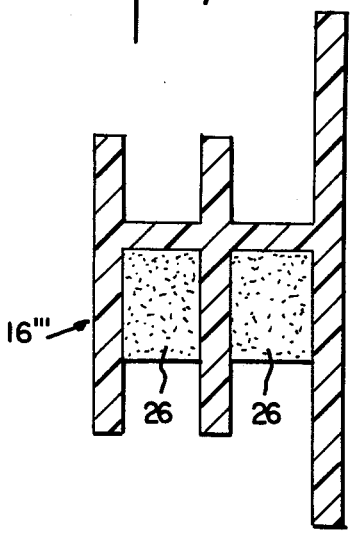
FIG. 17 shows a horizontal support member with storage capacity.
Figure 16:
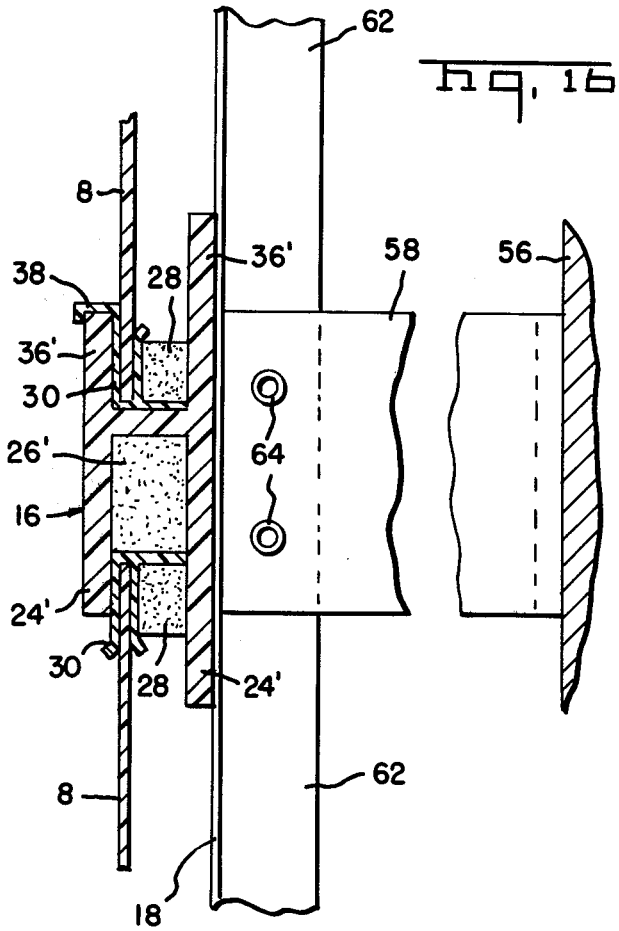
FIG. 16 is a cross-sectional view taken along the lines 16—16 of FIG. 1 showing a horizontal support member and window stand-off means.

As mentioned earlier, when a plurality of panels make up a window, horizontal supports 16 and vertical supports 18 are provided to complete an installation. A typical horizontal support 16 (FIG. 16) incorporates the various elements of both a header and a sill, the upstanding legs 36' cooperating with the header 10 to retain the upper panel 8, and the depending legs 24' and gaskets 26' cooperating with the sill 12 to retain the lower panel 8. Support and retention of the inside vertical edges of all panels 8 is accomplished by the vertical support member 18 as shown in FIGS. 14 and 15. A double sided panel retention gripping member 48' is riveted to the vertical support 18 and cooperates with cover members 50 to retain the inside vertical panel edges in a manner similar to that of the flange members 14. Vertical supports 18 are positioned directly in front of the prime window mullions 56 and are, at critical points, secured to the mullions by means of a plastic stand-off member 58 (FIGS. 14 and 16). Member 58 is screwed or riveted to the prime window mullion as at 60 on one end and is riveted to the ribs 62 on the backside of support 18 as at 64. The ribs 62 serve also as dissipators of coldness to prevent distortion of the flat area of the support 18. Since all members of the window are of plastic material, the entire window in non-conductive.

To install a window, a header 10, sill member 12 and two side flanges 14 are secured to the inside walls of a window opening by any desired means such as screws, power driven studs or the like. These members should be installed with appropriate caulking to eliminate infiltration of cold air. The horizontal and vertical support members 16 and 18 are then positioned and held temporarily in place by means of a double sided sticky foam type tape (not shown). When all members are positioned thusly, holes are drilled and the members are permanently connected with pop rivets. Retention gripping members 48, 48' are then riveted in the side flanges 14 and on the vertical support 18 respectively, the panel members 8 are cut to size and fitted with edge moldings 30, are then placed in the header and sill members and are secured by the insertion of the covers 50.

Figure 18:
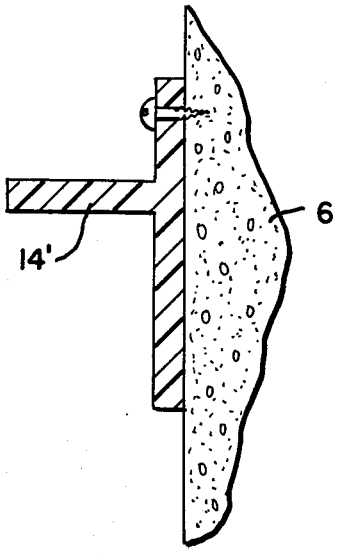
FIG. 18 is a cross-sectional view showing a side flange to be used when the window is mounted outside the opening.

When it is desired to install the storm window outside the window opening, a header 10' (FIG. 3) and sill member 12' (FIG. 8) are utilized and are mounted as illustrated (FIGS. 3 and 8) on the inside vertical surface of the wall as at 66. The side flanges 14' to be used with this installation are shown in FIG. 18. Apart from this mounting difference, the remaining window elements remain the same as previously described.

Figure 4:
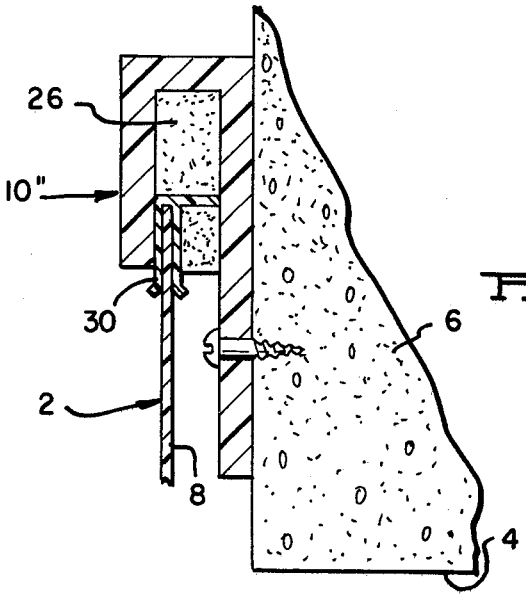
FIG. 4 is a view similar to FIG. 3 but showing a header which would be used when the appearance of an external mounting flange would be objectionable.
Figure 5:
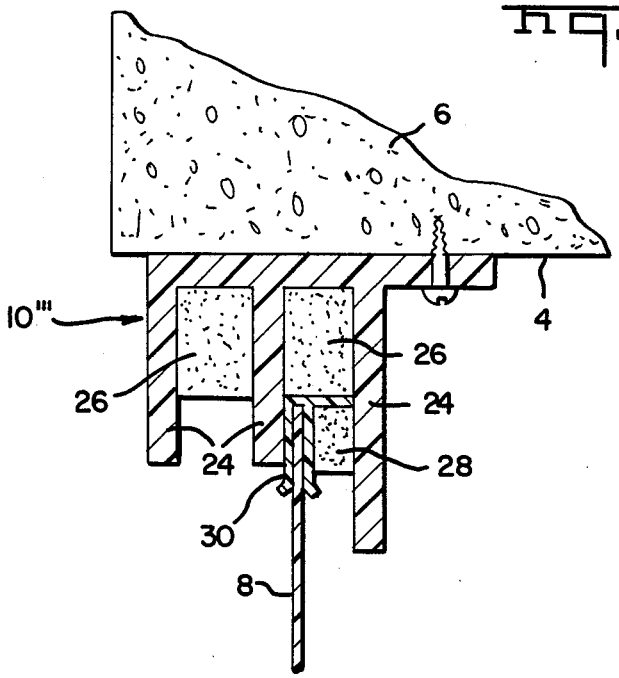
FIG. 5 is a cross-sectional view showing a regressed type header member with storage capacity.
Figure 6:
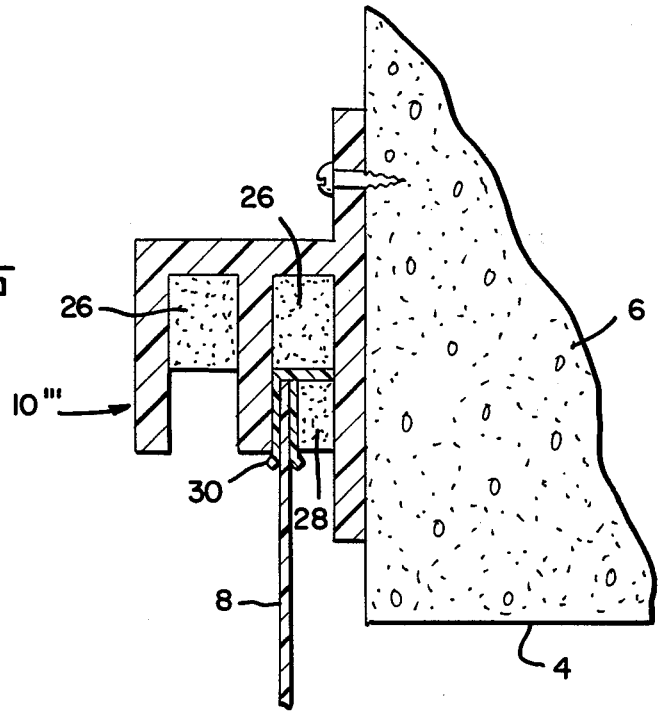
FIG. 6 is a cross-sectional view illustrating a header member with storage capacity to be used on an "outside the opening" application.
Figure 10:
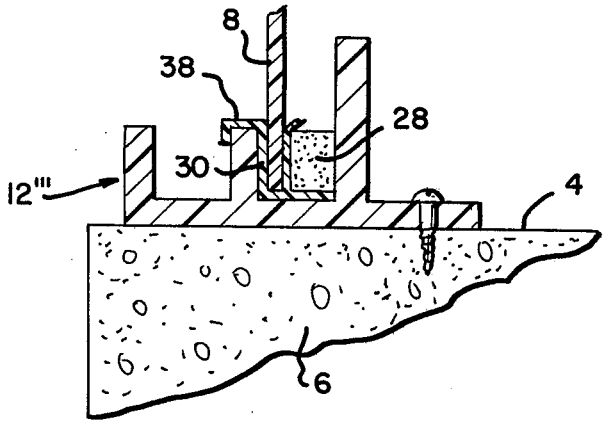
FIG. 10 shows a sill member with storage capacity to be used in conjunction with the header shown in FIG. 5.
Figure 11:
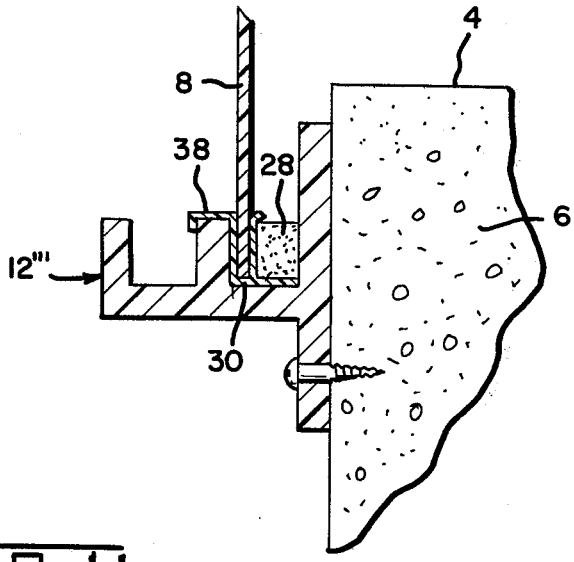
FIG. 11 shows a sill member with storage capacity to be used on an outside mount.
Figure 19:
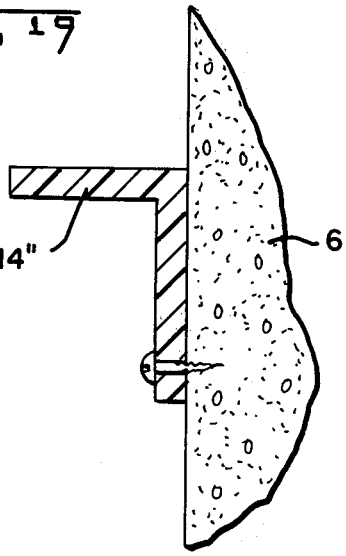
FIG. 19 shows a further side flange for use on an "outside the opening" mount when the mounting flange would be objectionable.

In some applications, the visibility of the mounting screws may be objectionable. To overcome this, header 10" (FIG. 4), sill 12" (FIG. 9) and flanges 14" (FIG. 19)

are employed. The mounting screws, in this embodiment, will be hidden behind the panel members.

In cases where panels will be frequently removed, it is desirable to provide a means for easy storage of the removed panels. This is accomplished by means of a special header 10''', sill member 12''' and horizontal supports 16''' (FIGS. 5, 6, 10, 11 and 17), each of these members having an additional depending leg and appropriate gaskets to permit insertion of a second panel 8 for storage while it is not being used in its own opening. If this type storage is not desirable and space permits, a header and sill 10' and 12' (FIGS. 3 and 8) can be mounted on a blank wall near or away from the window to provide needed storage areas.

Figure 20:
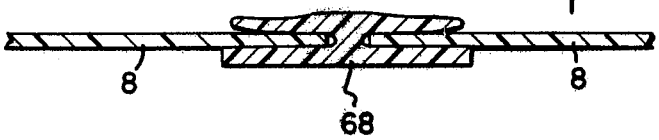
FIG. 20 is a cross-sectional view illustrating a panel joining means.

At times, for purposes of economy, it may be desired to extend a panel rather than to discard it and cut a new one. This is accomplished through the use of a panel extender extrusion 68 (FIG. 20) having slotted means on both sides to accommodate two panel edges in interfitting relationship.

Figure 23:
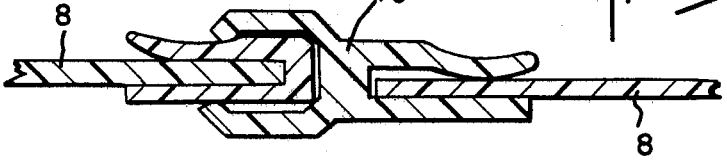
FIG. 23 is a cross-sectional view illustrating a panel extension means.

FIG. 23 illustrated a frame extender 70 which can increase the width of the panel edge molding and can also mate with another panel member as shown.

Figure 24:
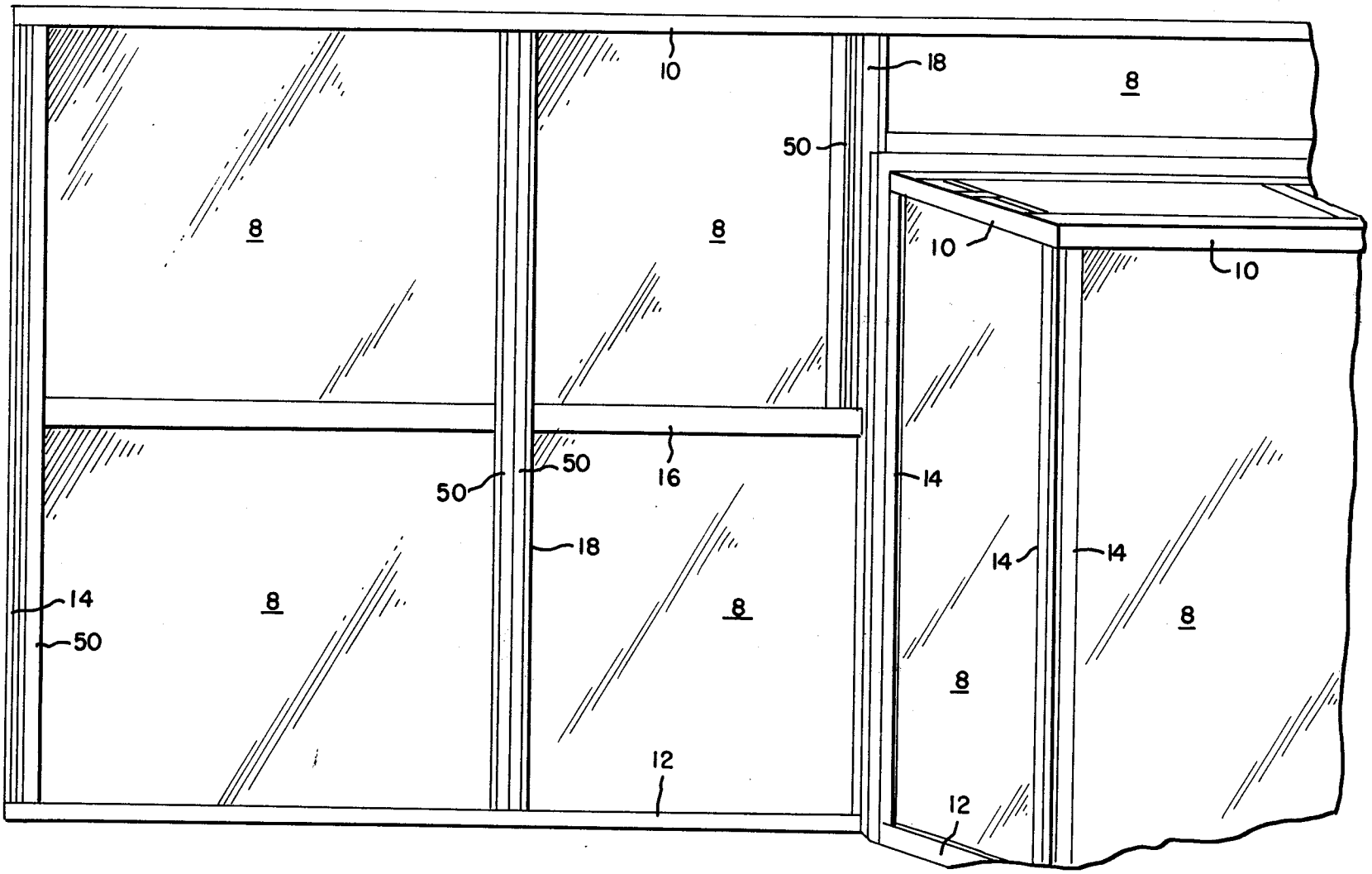
FIG. 24 is a drawing showing the manner in which protruding objects in a prime window may be "built into" the storm window to eliminate the need for their removal for storm window installation.
Figure 25:
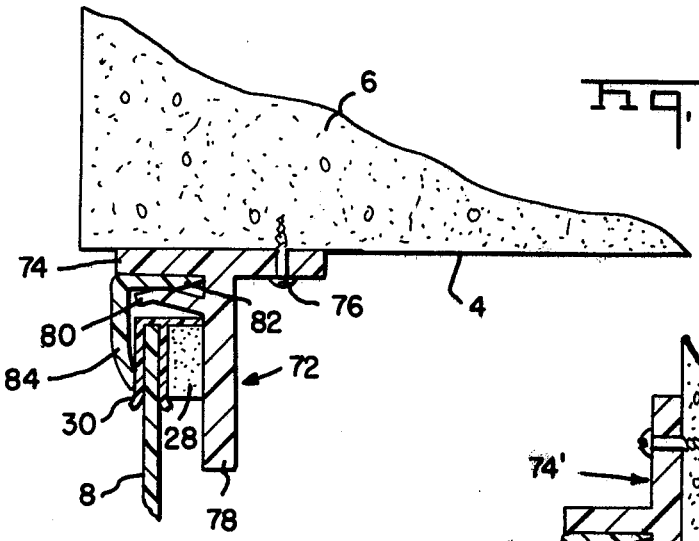
FIG. 25 is a cross-sectional view similar to FIG. 12 but showing an alternative method of retaining the window panel in the vertical side flange members in a regressed type application.
Figure 26:
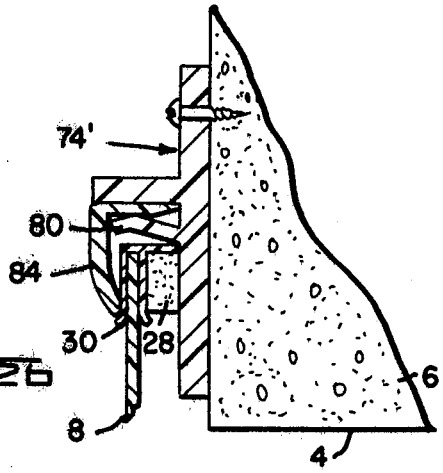
FIG. 26 is a view similar to FIG. 18 but showing the panel retention means of FIG. 25.
Figure 27:
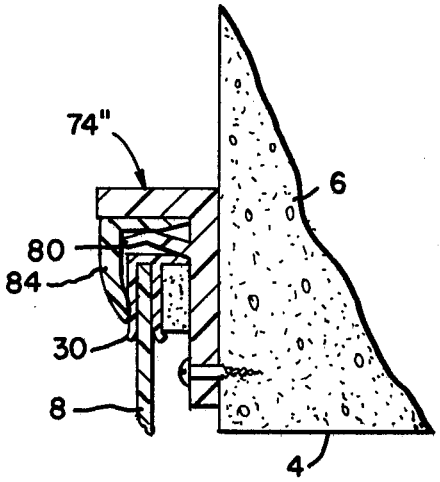
FIG. 27 is a view similar to FIG. 19 also showing the alternative, non-locking type of panel retention means.
Figure 28:
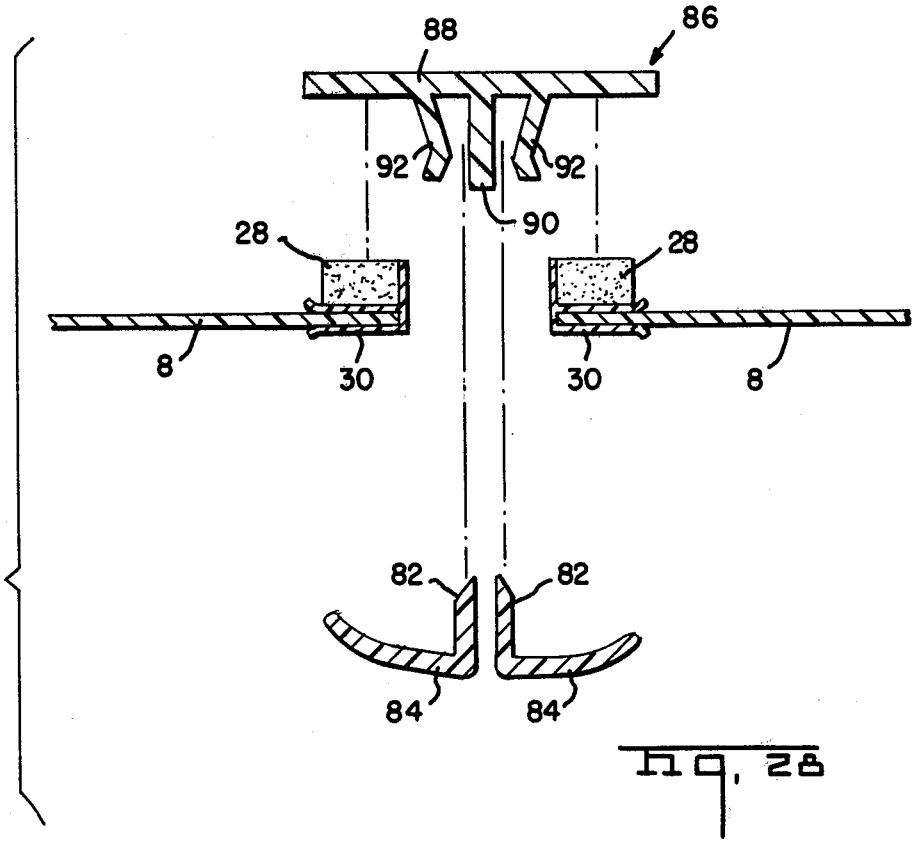
FIG. 28 is an exploded cross-sectional view similar to FIG. 14 and showing the non-locking panel retention means as used in conjunction with vertical support members.

Some industrial windows have protruding objects mounted therein which cannot easily be removed or which may not be desired to be removed, such as an airconditioning unit, vents, internal control mechanisms or the like. FIG. 24 shows the manner in which the present invention is used to enclose a protruding fan. With the disclosed window system objects of this nature can be built around simply by constructing a frame made up of headers and sills and flange members riveted together back to back to form the outside corners. The object can thereby be "boxed into" the window to provide maximum insulation and will still permit easy access to the object by virtue of the ease with which panels can be installed and removed.

FIGS. 25–28 show an alternative embodiment to be used when it is not desired to have the panels "locked" in so securely. The covers are held by a frictional fit along their entire length which is enough to retain the panels, but they are much easier to remove since they don't have any kind of locking detent to be engaged by the spring member on the cover gripping member.

When this method of panel retention is used, the horizontal members of the window assembly remain the same as previously described but the vertical members are replaced by those shown in FIGS. 25–28. A flange member 72 is provided having a base section 74, by which it is mounted in the window opening as at 76, and a depending arm 78 which provides the back up for the panel 8. Integral with the arm 78 is a spring member 80 which cooperates with the section 82 of a cover member or panel retention member 84. The member 84 is frictionally held between the spring 80 and base section 74 with sufficient pressure to retain the panel members. When it is desired to remove a panel, retainer 84 is easily removed since it is in an unlocked condition. A similar flange member 74' (FIG. 26) is used for an outside the window opening application and a flange 74'' (FIG. 27) for outside the opening application where the mounting screws would be objectionable.

In this type of application, the vertical support members previously described are replaced by a vertical support member 86 (FIG. 28) having a base section 88, a centrally disposed depending leg 90 and a pair of opposed spring members 92 which cooperate with the leg 90 to retain a panel 8 on each side by virtue of its mating with a pair of covers 84. All cover members 84, those in the side flanges and those in the vertical support, are removed when the removal of a panel is desired.

As an alternative to on-site fabrication, the various members and panels can be precut to size and installed at the site.

The present invention may be subject to many modifications and variations without departing from the spirit or essential characteristics thereof. The present embodiments should therefore be considered in all respects as merely illustrative and not restrictive of the scope of the present invention.

What is claimed is:

1. An auxiliary or storm window closure for primary window frames having diverse, transverse, and longitudinal dimensions, said closure comprising:

a plurality of parallel, rectangular, transparent panels;

a plurality of elongated panel edge moldings having longitudinal slots which engage the edges of said panels, said moldings being positioned on the sides and along the lengthwise edges of said panels;

said moldings including a longitudinal base with a longitudinal portion thereof defining the bottom of each slot, walls extending from said base to define the sides of each slot;

gaskets positioned adjacent one of said walls to prevent infiltration of air around said panels and through said prime window frames;

a plurality of horizontal supports adjoining vertically adjacent panels along their length to form a sheet, a plurality of said sheets being provided;

each of said horizontal supports having a generally flat, longitudinal surface adapted to be placed across said frame and fastened thereto between vertically adjacent panels and having a gasket receiving slot with an opening facing vertically for receiving a vertically adjacent panel and a gasket;

a gasket positioned in each gasket receiving slot to sealingly engage the horizontal supports to an adjacent panel;

a plurality of vertical supports adjoining adjacent sheets, each of said vertical supports having a generally flat, longitudinal surface adapted to be placed across said frame and fastened thereto between said sheets and having a vertical slot with an opening for receiving said adjacent sheets;

and means for attaching said supports to said window frame.

2. The closure of claim 1 wherein said horizontal slot is formed by a pair of unstanding legs.

3. The closure of claim 2 wherein said gasket receiving slot is formed by a pair of depending legs.

4. The closure of claim 1 wherein said means for attaching said sheet to said window frame comprises:

a header member fastened along the top of said window frame;

a sill member fastened along the bottom of said window frame; and said flange members secured to the sides of said prime window.

5. The method of installing an auxiliary or storm window for window frames of various sizes comprising the following steps:

a. a selecting parallel, rectangular, transparent panels, b. installing on the periphery of said panels elongated panel edged moldings having longitudinal slots which engage the edges of said panels, c. installing gaskets adjacent said moldings to prevent infiltration of air around said panels and through said frame, d. placing a sill member along the bottom of said window frame, e. installing one of said panels on the sill member, f. placing a horizontal support having a gasket enclosed within slots therein over the top of the installed window panel, g. securing said horizontal support to said frame, h. installing another panel into a slot on the top of said horizontal support, said installed panels comprising a first sheet, i. repeating steps f, g, and h for another panel until the height of said window frame is enclosed by said first sheet;

j. placing a vertical support along the sides of said first sheet;

k. securing said vertical support to said frame;

l. repeating steps a. through h. to form a second sheet;

m. fastening said second sheet to said vertical support; and n. repeating steps j., k., l., and m. until the width of the window frame is enclosed by said sheets.

* * * * *

UNITED STATES PATENT AND TRADEMARK OFFICE

CERTIFICATE OF CORRECTION

PATENT NO. : 4,215,517

DATED : August 5, 1980

INVENTOR(S) : WILLIAM EVERSON, Perkasie, Pa.

It is certified that error appears in the above-identified patent and that said Letters Patent are hereby corrected as shown below:

In the title, delete "Auxilliary" and insert therefor

--Auxiliary--;

Column 6, line 60, delete "said" and insert therefor

--side--

Signed and Sealed this

*Seventh* Day of *April 1981*

[SEAL]

*Attest:*

RENE D. TEGTMEYER

*Attesting Officer*

*Acting Commissioner of Patents and Trademarks*